US012064039B2

(12) United States Patent
Guo

(10) Patent No.: US 12,064,039 B2
(45) Date of Patent: Aug. 20, 2024

(54) BABY BED

(71) Applicant: CHINA WONDERLAND NURSERYGOODS CO., LTD., Guangdong (CN)

(72) Inventor: Zhengwen Guo, Guangdong (CN)

(73) Assignee: CHINA WONDERLAND NURSERYGOODS CO., LTD., Guangdong (CN)

( * ) Notice: Subject to any disclaimer, the term of this patent is extended or adjusted under 35 U.S.C. 154(b) by 564 days.

(21) Appl. No.: 17/297,451

(22) PCT Filed: Sep. 17, 2019

(86) PCT No.: PCT/CN2019/106186
§ 371 (c)(1),
(2) Date: May 26, 2021

(87) PCT Pub. No.: WO2020/103546
PCT Pub. Date: May 28, 2020

(65) Prior Publication Data

US 2022/0007853 A1 Jan. 13, 2022

(30) Foreign Application Priority Data

Nov. 21, 2018 (CN) ..... 201821926295.5

(51) Int. Cl.
*A47D 7/02* (2006.01)
*A47D 9/00* (2006.01)
*A47D 15/00* (2006.01)

(52) U.S. Cl.
CPC ..... *A47D 7/02* (2013.01); *A47D 9/012* (2022.08); *A47D 15/008* (2013.01)

(58) Field of Classification Search
CPC ..... A47D 7/00; A47D 7/002; A47D 7/005; A47D 7/007; A47D 7/01; A47D 7/02;
(Continued)

(56) References Cited

U.S. PATENT DOCUMENTS 3,115,927 A * 12/1963 Znamirowski ..... E06B 9/90 160/301
4,768,243 A * 9/1988 Waples ..... A47D 7/02 5/100

(Continued)

FOREIGN PATENT DOCUMENTS

CN 2266940 Y 11/1997
CN 201996052 U 10/2011

(Continued)

OTHER PUBLICATIONS

Office Action dated Oct. 11, 2022 for JP-2021-529118, with English Translation, 10 pages.

(Continued)

*Primary Examiner* — Justin C Mikowski
*Assistant Examiner* — George Sun
(74) *Attorney, Agent, or Firm* — Quarles & Brady LLP

(57) ABSTRACT

A baby crib includes a crib body, the crib body includes: a crib frame formed by a plurality of rods; a soft goods made of a soft material and fixed on the crib frame; and a crib accommodating space enclosed by the crib frame and the soft goods. An entire upper rod or a portion of the upper rod on one of sides of the crib frame is adjustable in height in a vertical direction between upper and lower ends of the crib frame. The crib frame is provided with a tightening mechanism. When the upper rod is adjusted in height and drives the upper rod soft goods to move, the tightening mechanism is capable of being contracted or stretched correspondingly to provide a tightening force to the upper rod soft goods.

8 Claims, 10 Drawing Sheets

(58) Field of Classification Search
CPC . A47D 7/03; A47D 9/00; A47D 9/005; A47D 9/008; A47D 9/012; A47D 11/00; A47D 11/002; A47D 11/005; A47D 11/007; A47D 13/00; A47D 13/02; A47D 13/06; A47D 13/061; A47D 13/063; A47D 13/065; A47D 13/066; A47D 13/068; A47D 15/00; A47D 15/001; A47D 15/006; A47D 15/008
See application file for complete search history.

(56) References Cited

U.S. PATENT DOCUMENTS

| | | | | |
|---|---|---|---|---|
| 5,432,962 | A * | 7/1995 | Huang | A47D 7/02 5/100 |
| 10,694,866 | B2 * | 6/2020 | Gallina | A47D 9/02 |
| 10,722,047 | B2 * | 7/2020 | Gallina | A47D 9/02 |
| 2002/0083524 | A1 | 7/2002 | Tharalson et al. | |
| 2002/0152550 | A1 | 10/2002 | Tharalson et al. | |
| 2005/0025790 | A1 | 2/2005 | Rock et al. | |
| 2005/0257903 | A1 * | 11/2005 | Schimko | B60J 1/208 160/370.22 |
| 2007/0027237 | A1 | 2/2007 | Hamano et al. | |
| 2007/0272375 | A1 * | 11/2007 | Hansen | B60J 1/2027 160/370.22 |
| 2010/0005586 | A1 | 11/2010 | Kappenberg et al. | |
| 2011/0258776 | A1 * | 10/2011 | Schwartz | A47D 7/00 5/100 |
| 2012/0126511 | A1 | 5/2012 | Winterhalter | |
| 2015/0075726 | A1 | 3/2015 | Byun | |
| 2018/0303251 | A1 | 10/2018 | Ertelt | |

FOREIGN PATENT DOCUMENTS

| | | | | | |
|---|---|---|---|---|---|
| CN | 206228077 | U | | 6/2017 | |
| CN | 207837255 | U | | 9/2018 | |
| EP | 3354164 | A1 | | 8/2018 | |
| EP | 3354165 | B1 | | 8/2018 | |
| GB | 2472853 | A | | 2/2011 | |
| GB | 2472853 | A | * | 2/2011 | A47D 15/008 |
| GB | 2472853 | A | * | 2/2011 | A47D 15/008 |
| JP | 57-051554 | U | | 3/1982 | |
| JP | 2006160041 | A | | 6/2006 | |
| JP | 2009241879 | A | | 10/2009 | |
| JP | 3191949 | U | | 7/2014 | |
| JP | 3184813 | U | | 7/2023 | |
| KR | 20080003372 | U | | 8/2008 | |
| WO | WO-2008-043542 | A2 | | 4/2008 | |
| WO | WO-2016-206657 | A1 | | 12/2016 | |

OTHER PUBLICATIONS

Corresponding Japanese Decision on Refusal Issued on Apr. 24, 2023. JP Patent Application No. 2021-529118. Applicant Ming Men (China) Children's Goods Co., Ltd.

International Search Report for International Application No. PCT/CN2019/106186 mailed Oct. 28, 2019, 10 pages; with English Translation.

Examination Report #1 dated Apr. 29, 2022 for Australia App. No. 2019382420, 4 pages.

Extended European Search Report dated Mar. 18, 2022 for European App. No. 19887851, 7 pages.

AU Office Action of application No. 2019382420 dated Mar. 15, 2023.

Reconsideration Report by Examiner Before Appeal, JP Patent No. 2021-529118, Nov. 28, 2023 (with English Translation).

Notice of Allowance, Korean Patent Application No. 1020217018771, May 24, 2024.

Notice of Allowance, Australian Patent Application No. 2021258027, Feb. 9, 2024.

Office Action, Japanese Application No. 2023072874, Feb. 5, 2024.

* cited by examiner

BABY BED

CROSS-REFERENCE TO RELATED APPLICATIONS

This application is a 371 National Stage of PCT/CN2019/106186 (WO 2020/103546 A1), filed on Sep. 17, 2019, entitled "BABY BED," which claims priority to CN Patent Application No. 201821926295.5 filed on Nov. 21, 2018, the entire teachings of which are incorporated herein by reference, in their entirety, for all purposes.

TECHNICAL FIELD

The present disclosure relates to the technical field of baby cribs.

BACKGROUND

Baby crib is a bed for infants or toddlers to rest and play. The baby crib is required to be cleaned up after being used for a long time, and the infants or toddlers need to play outside after they have been in the cribs for a long time. In this case, the infant or toddler needs to be taken out of the baby crib. Most of the conventional baby cribs has a crib body that is high above the ground, and four walls of the crib body are also relatively high, and the crib body is also very narrow, which are inconvenient to take the infant or a toddler out. In order to facilitate the infant or a toddler to be taken out, a lower-adjustable upper rod soft goods can be provided on one side of the crib body of the baby crib. When it is necessary to take the infant or toddler out of the crib body of baby crib, the upper rod soft goods can be manually lowered by a certain distance, so as to take the infant or a toddler out safely and conveniently. Additionally, after the upper rod soft goods is lowered by an appropriate distance, people can clearly observe a state of the infant in the crib body even when they are far away from the baby crib, and it is not necessary to walk nearby to look after the infant in the crib body due to the too high surrounding walls of the crib body that blocks their sight. However, after the upper rod soft goods is lowered, it is piled up, which, on one hand, is unsightly. On the other hand, it is necessary to avoid the piled-up upper rod soft goods when taking the infant out. In other words, the piled-up upper rod soft goods may cause certain safety hazards. Therefore, it is necessary to improve the conventional baby cribs to overcome the above-mentioned problems.

SUMMARY

According to various embodiments, a baby crib is provided, which can address problems of unsightly appearance and safety hazards of the baby crib caused by the piling up of the upper rod soft goods after it is lowered.

A baby crib includes a crib body. The crib body includes a crib frame formed by a plurality of rods, a soft goods made of a soft material and fixed on the crib frame, and a crib accommodating space enclosed by the crib frame and the soft goods. An entire upper rod or a portion of the upper rod on one of sides of the crib frame is adjustable in height in a vertical direction between upper and lower ends of the crib frame. The crib frame is provided with a tightening mechanism. One end of the tightening mechanism is connected and fixed to the crib frame and the other end thereof is connected to an upper rod soft goods fixed on the upper rod. When the upper rod is adjusted in height and drives the upper rod soft goods to move, the tightening mechanism is capable of being contracted or stretched correspondingly to provide a tightening force to the upper rod soft goods.

Compared to prior art, the tightening mechanism of the baby crib of the present application has one end connected and fixed to the crib frame, and the other end thereof is connected to the upper rod soft goods fixed on the upper rod. When the upper rod is adjusted in height and drives the upper rod soft goods to move, the tightening mechanism can be contracted or stretched correspondingly to provide the tightening force to the upper rod soft goods, such that the upper rod soft goods to be piled up is pulled by the tightening mechanism to be maintained in an unfolded state, thereby solving the problems of unsightly appearance and safety hazards of the baby crib caused by the piling up of the upper rod soft goods after it is lowered.

DETAILED DESCRIPTION OF THE EMBODIMENTS

Figure 1:
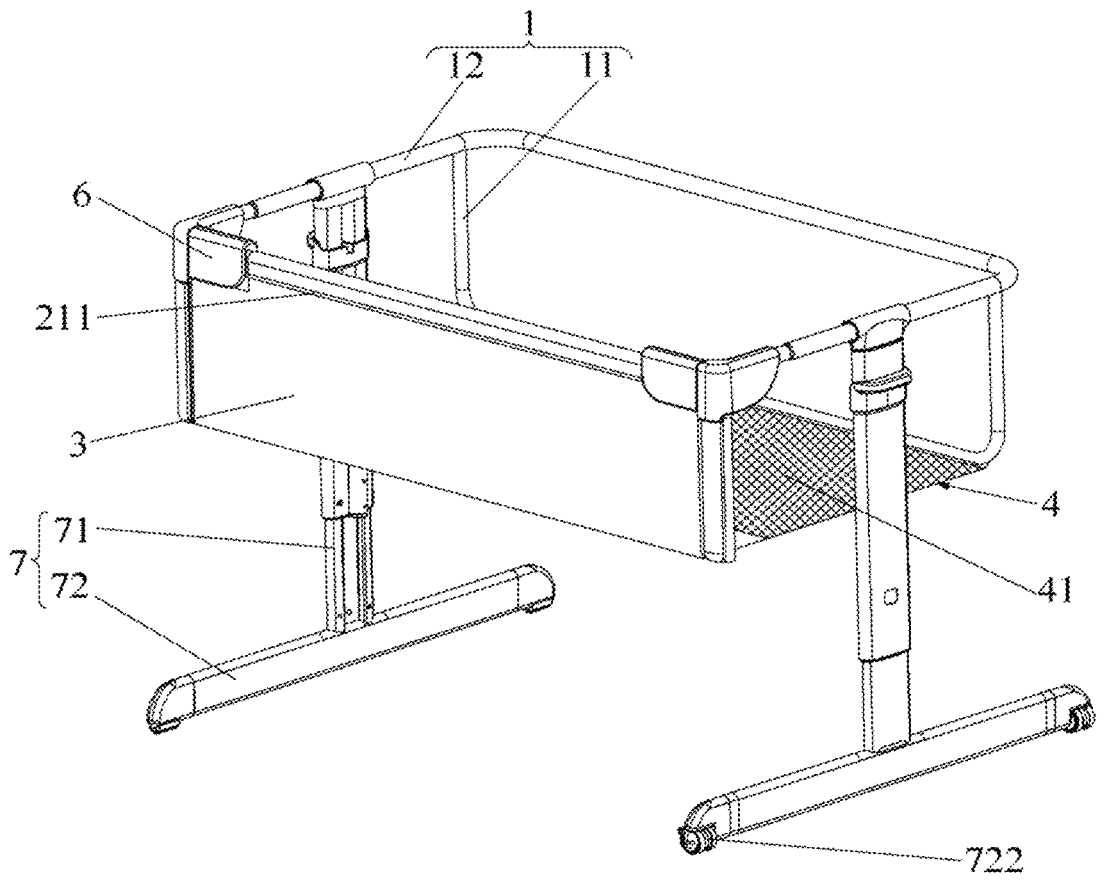
FIG. 1 is a structural schematic view of an upper rod soft goods of a baby crib in a fixed state according to one of the embodiments of the present application.

The present application provides a baby crib that can address a pile-up of a soft goods caused after the soft goods is lowered. The baby crib includes a crib frame formed by a plurality of rods, a soft goods made of a soft material and fixed on the crib frame, and a crib accommodating space enclosed by the crib frame and the soft goods. An upper rod on one side of the crib frame can be adjusted in height in a vertical direction between upper and lower ends of the crib frame, thus driving the soft goods fixed on the upper rod to be adjusted, such that it is more convenient for a caretaker to observe an infant in the baby crib or take the infant out. In addition, the crib frame is provided with a tightening mechanism, which can provide a tightening force to tighten an upper rod soft goods fixed on the upper rod when the upper rod is adjusted in height. For this purpose, one end of the tightening mechanism is connected and fixed to the crib frame, and the other end thereof is connected to the soft goods fixed on the upper rod. The tightening mechanism may be any mechanisms that can provide tightening capabilities, including elastic mechanisms, or fastening mechanisms.

In order to facilitate the understanding of the present application, the present application will be described more comprehensively with reference to the relevant drawings. Embodiments of the present application are shown in the accompanying drawings. However, the present application can be implemented in many different forms and is not limited to the embodiments described herein. On the contrary, providing these embodiments is to make the understanding of the disclosure of the present application more thorough and comprehensive.

Referring to FIGS. 1 to 3 and 7, which are structural schematic views of a baby crib 100 according to one of the embodiments of the present application. As shown in the figures, the baby crib 100 includes a crib body (not shown in the figure). The crib body includes a crib frame 1 formed by a plurality of rods, a soft goods (not shown in the figure) made of a soft material and fixed on the crib frame 1, and a crib accommodating space enclosed by the crib frame 1 and the soft goods. An entire upper rod 21 or a portion of the upper rod 21 on one of sides of the crib frame 1 can be adjusted in height in a vertical direction between upper and lower ends of the crib frame 1. The crib frame 1 is provided with a tightening mechanism 4. One end of the tightening mechanism 4 is connected and fixed to the crib frame 1 and the other end thereof is connected to an upper rod soft goods 3 fixed on the upper rod 21. When the upper rod 21 is adjusted in height and drives the upper rod soft goods 3 to move, the tightening mechanism 4 can be contracted or stretched correspondingly to provide a tightening force to the upper rod soft goods 3.

Since one end of the tightening mechanism 4 provided on the crib frame 1 is connected and fixed to the crib frame 1, and the other end thereof is connected to the upper rod soft goods 3 fixed on the upper rod 21, when the upper rod 21 is adjusted in height and drives the upper rod soft goods 3 to move, the tightening mechanism 4 can be contracted or stretched correspondingly to provide the tightening force to the upper rod soft goods 3, such that the upper rod soft goods 3 to be piled up is pulled by the tightening mechanism 4 to be maintained in a spreading state, thereby solving the problems of unsightly appearance and safety hazards of the baby crib 100 caused by the piling up of the upper rod soft goods 3 after it is lowered.

Figure 2:
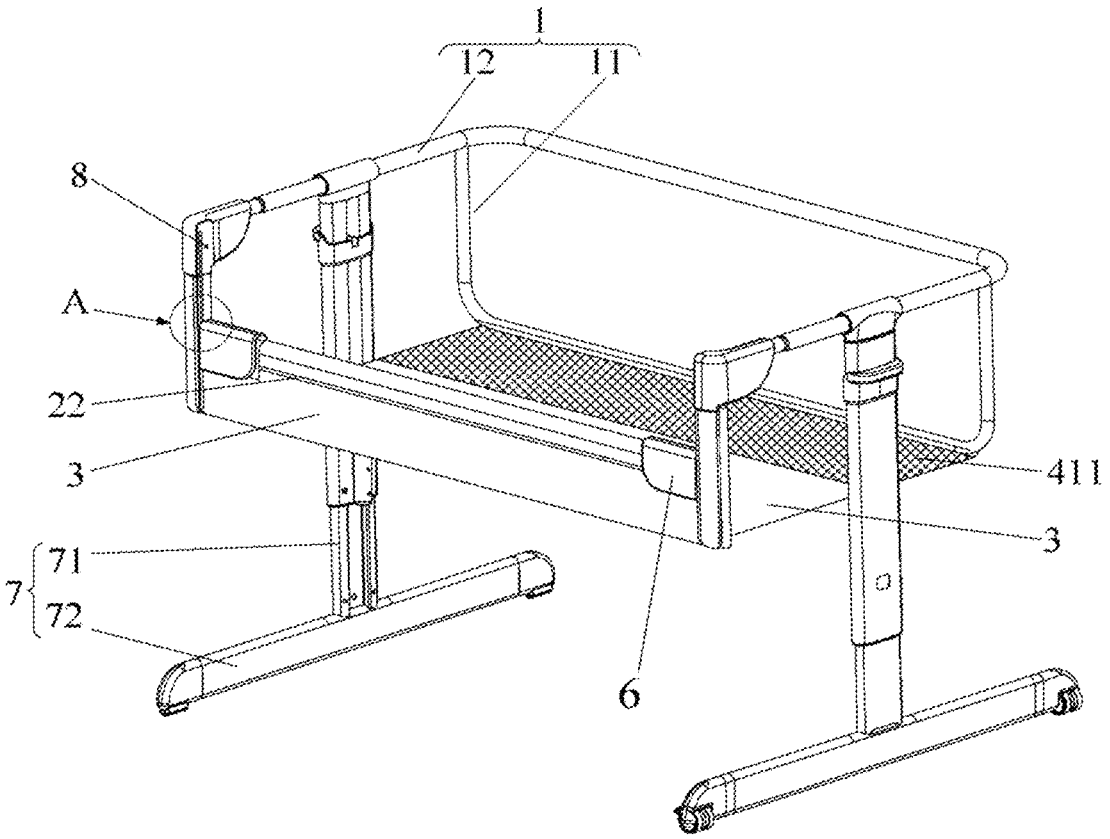
FIG. 2 is a structural schematic view of an upper rod soft goods of a baby crib in a lowered state according to one of the embodiments of the present application.
Figure 3:
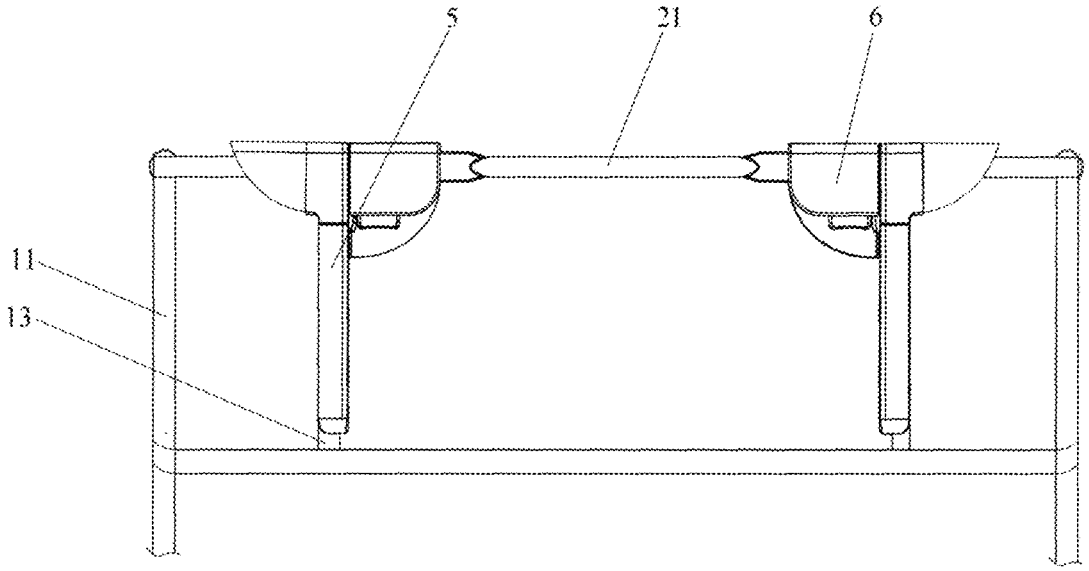
FIG. 3 is a front view of a baby crib in which a portion of an upper rod can be adjusted in height according to another embodiments of the present application.

Specifically, the crib frame 1 includes a front side, a rear side, a left side, a right side, and a bottom side. The upper rod 21 can be provided on an upper end of the front side, the rear side, the left side, the right side, or any combination thereof. In order to clearly illustrate the structure of the present application, in the drawing of this embodiment, the upper rod 21 is provided on the front side of the crib frame 1. The crib frame 1 may be provided with rods for supporting a frame of the crib frame 1. The rods can be divided into an erect rod 11, a horizontal rod 12, and a vertical rod 13. The erect rod 11 and the horizontal rod 12 can constitute the frame supporting the crib frame 1. The upper rod 21 is connected to the two erect rods 11 on the same side thereof. The entire upper rod 21 located between the two erect rods 11 can be adjusted in height in the vertical direction, as shown in FIGS. 1 to 2. In another embodiment, as shown in FIG. 3, the vertical rod 13 parallel to the erect rod 11 may be further provided between adjacent erect rods 11. Generally, an inner diameter of the erect rod 11 is less than that of the vertical rod 13. If the crib frame 1 is provided with the vertical rods 13, the upper rods 21 on each side are connected to the corresponding vertical rod 13 between the two erect rods 11. The context of "the entire upper rod 21 or a portion of the upper rod 21 on one of the sides of the crib frame 1 can be adjusted in height in the vertical direction between the upper and lower ends of the crib frame 1" refers to that the entire upper rod 21 connected between the two erect rods 11 are adjusted in height in the vertical direction, alternatively, only a portion of the upper rod 21 connected between the vertical rods 13 located between the two erect rods 11 is adjusted in height in the vertical direction, such that the upper rod 21 can be selectively adjusted in height entirely or partially.

It should be noted that, in the baby crib according to the present application, an adjustment range of the upper rod 21 can be the entire upper rod 21 or a part of the upper rod 21, the difference lies only in that the height adjusting mechanism is directly provided on the erect rod or separately, and the configuration manners of the crib frames fixed on the upper rod, which have the same performance.

Figure 4:
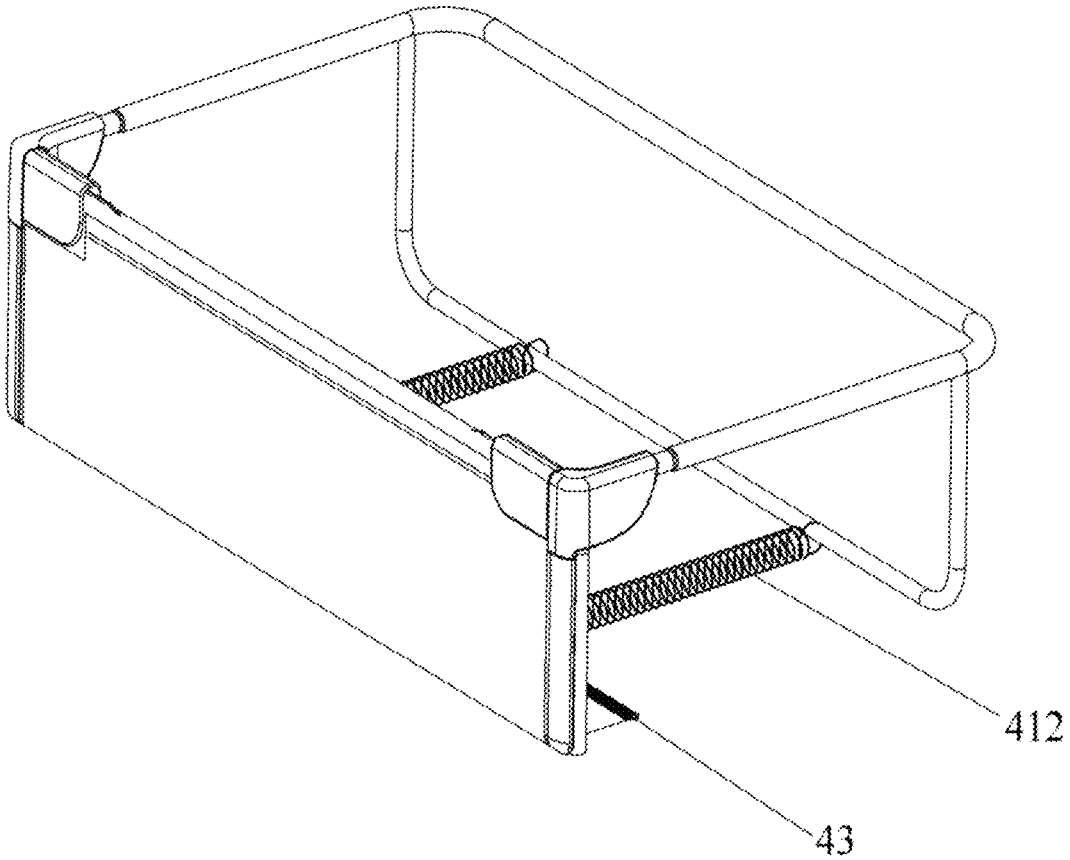
FIG. 4 is a partial structural schematic view of a variant of FIG. 1.
Figure 5:
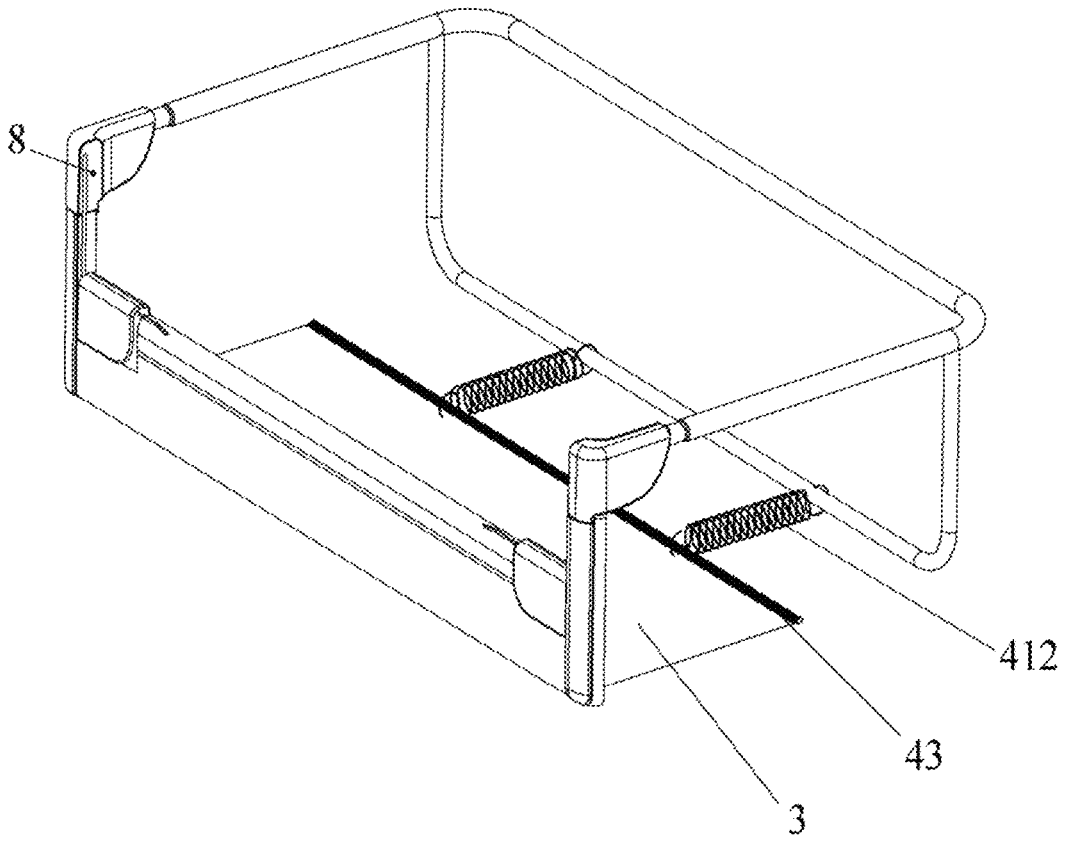
FIG. 5 is a partial structural schematic view of a variant of FIG. 2.

Referring to FIGS. 1 to 5 and 10, which are schematic structural views of the tightening mechanism 4 according to embodiments of the present application. As shown in the figures, the tightening mechanism 4 may be an elastic member 41 or a furling mechanism 42 (shown in FIG. 10). The elastic member 41 can be specifically exemplified as an elastic cloth 411, an elastic band (not shown in the figure) or a spring 412. One end of the tightening mechanism 4 is connected to a bottom side of the crib frame 1. The upper rod soft goods 3 extends to the bottom side of the crib frame 1 and is connected to the other end of the tightening mechanism 4. When the upper rod 21 is adjusted downward, the tightening mechanism 4 is contracted correspondingly, such that the upper rod soft goods 3 to be piled up can move towards the bottom side of the crib frame 1 and be stored at the bottom side of the crib frame 1, thus improving the appearance and safety of the baby crib 100. Correspondingly, when the upper rod 21 is adjusted upward, the tightening mechanism 4 can be stretched, such that the upper rod soft goods 3 will not be too tight. In one of the embodiments of the present application, as shown in FIGS. 1 and 2, the elastic member 41 may be the elastic cloth 411. A width of the elastic cloth 411 may be the same as the upper rod soft goods 3. One end of the elastic cloth 411 is connected to the upper rod soft goods 3, and the other end thereof is fixed to the crib frame 1. Specifically, the other end of the elastic cloth 411 is fixed to a rod on the bottom side of the crib frame 1. In another embodiment, as shown in FIGS. 4 and 5, the elastic member 41 may be a spring 412. The other end of the spring 412 is hooked to an edge of the upper rod soft goods 3. Specifically, a connected portion between the upper rod soft goods 3 and the spring 412 is a hard fabric edge 43. The other end of the spring 412 is fixed to the rod on the bottom side of the crib frame 1. The hard fabric edge 43 can be made of plastic or metal. The hard fabric edge 43 facilitates the fixed connection between the spring 412 and the upper rod soft goods 3, thereby avoiding the tearing of the upper rod soft goods 3. An outside of the spring 412 is sleeved with a cloth cover or plastic, which can prevent the spring 412 from being exposed to the outside, so as to ensure safety for the infants or toddlers. When the elastic member 41 is the elastic band, the elastic member 41 has a structure similar to that of the spring 412, which will not be described herein. It should be noted that the above description is only one of the embodiments of the present application. Of course, in other embodiments, any structure in which the crib frame is provided with a tightening mechanism to provide the tightening force when the upper rod is adjusted in height are fallen into the protection scope of the present application, and thus the present application is not limited to the above-mentioned embodiments.

Figure 10:
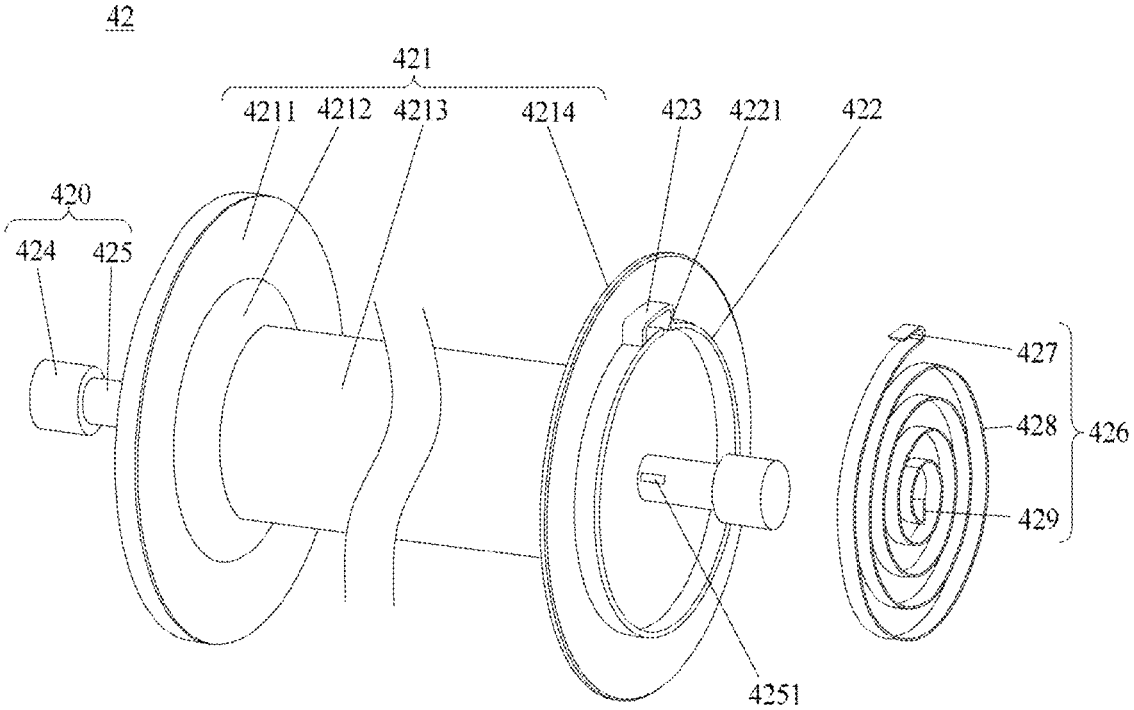
FIG. 10 is an exploded view of a furling mechanism according to one of the embodiments of the present application.

Referring to FIG. 10, which is a structural schematic view of the furling mechanism according to one of the embodiments of the present application. As shown in the figure, the tightening mechanism 4 may be the furling mechanism 42. The furling mechanism 42 includes a furling disk 421, a shaft 420, and a coil spring 426. The furling disk 421 can rotate around the shaft 420. Specifically, the furling disk 421 includes a first gear disk 4211, a second gear disk 4214, a furling shaft 4213 fixed between the first gear disk 4211 and the second gear disk 4214, and a flared segment 4212 provided at a connected portion between the first gear disk 4211 and the second gear plate disk 4214, and the furling shaft 4213. A length of the furling shaft 4213 is slightly greater than the width of the upper rod soft goods 3. The furling shaft 4213 is fixed to one end of the upper rod soft goods 3. The fixing method may be an adhesive fixing. A diameter of the flared segment 4212 decreases with the increase of the distance from the first gear disk 4211 or the second gear disk 4214. The flared segment 4212 is beneficial for folding the upper rod soft goods 3 neatly. The furling shaft 4213 can furl the upper rod soft goods 3. A retaining ring 422 is provide at an outer side of the first gear disk 4211 and the second gear disk 4214. The retaining ring 422 is shaped as an annular strip. The retaining ring 422 is provided with an opening 4221. A shield 423 is provided at an outside of the opening 4221. The shield 423 has a substantially U-shaped structure. Two legs of the U-shaped structure are fixedly connected to the outside of the retaining ring 422 located on both sides of the opening 4221, respectively. The shaft 420 includes an inner shaft 425 having a smaller radius, and an outer shaft 424 having a larger radius and fixed at both ends of the inner shaft 425. The inner shaft 425 is provided with a radial slot 4251, which is located inside the retaining ring 422. The coil spring 426 includes a coil spring body 428, a first hook portion 427 provided at one end of the coil spring body 428, and a second hook portion 429 provided at the other end of the coil spring main body 428. The first hook portion 427 and the second hook portion 429 can be formed by bending both ends of the coil spring main body 428. The coil spring 426 is provided inside the retaining ring 422. The first hook portion 427 is hooked to the opening 4221 of the retaining ring 422. The second hook portion 429 is hooked to the radial slot 4251 of the inner shaft 425. In addition, an outside of the coil spring 426 can be provided with a cover plate (not shown in the figure), which is fixed to the retaining ring 422 to cover the coil spring 426. Subject to an elastic action of the coil spring 426, the coil spring 426 can act on the furling disk 421 and rotates around the shaft 420. Specifically, the furling mechanism 42 can be fixed to the rod 21 on the bottom side of the crib frame 1 via the outer shaft 424. The furling shaft 4213 is adhesively fixed to one end of the upper rod soft goods 3. When the upper rod 21 is adjusted in height and drives the upper rod soft goods 3 to move, the coil spring 426 of the furling mechanism 42 can be correspondingly contracted or stretched to provide the tightening force to the upper rod soft goods 3.

Figure 7:
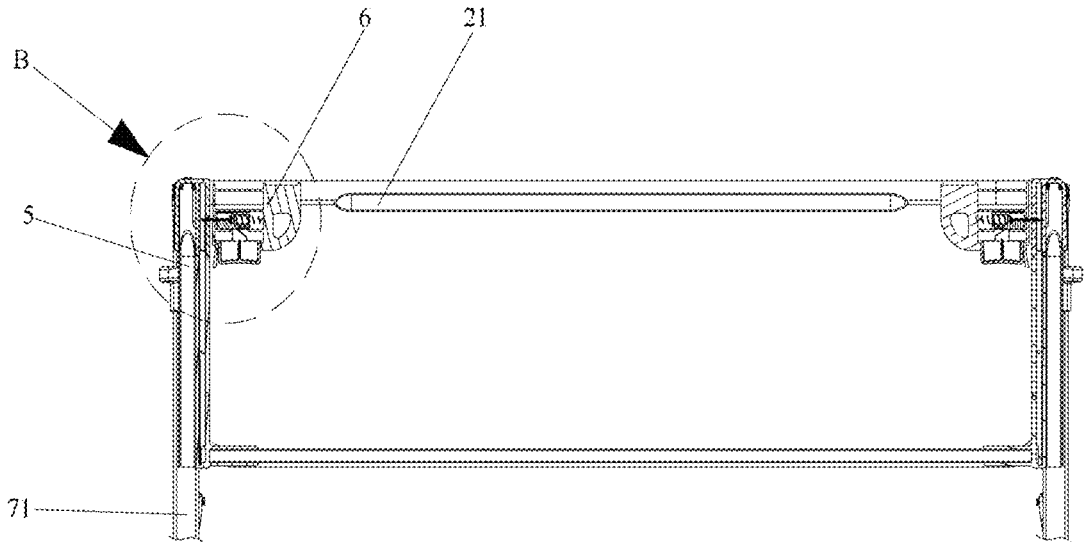
FIG. 7 is a partial cross-sectional view of a sliding block shown in FIG. 1.
Figure 9:
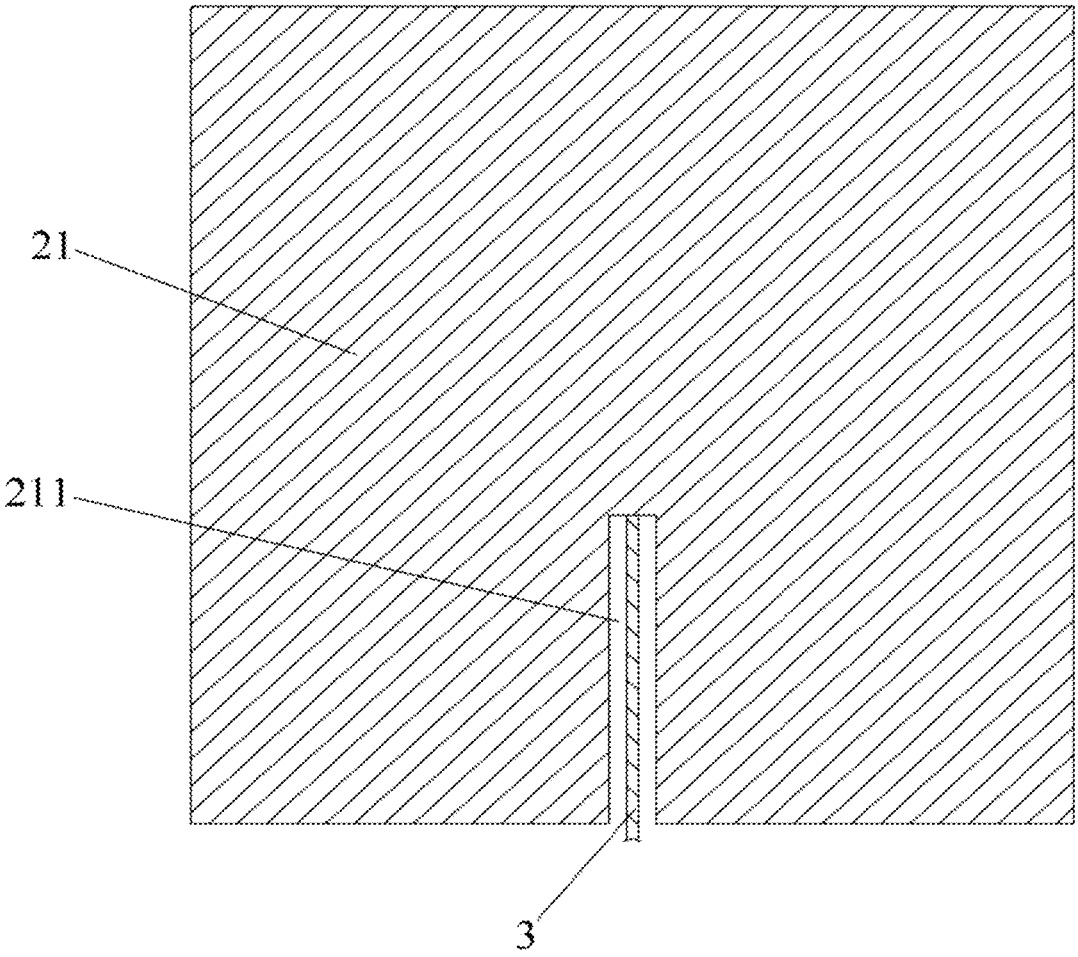
FIG. 9 is a partial cross-sectional view of an upper rod provided with a groove according to one of the embodiments of the present application.

Referring to FIGS. 1 and 7, in this case, the upper rod 21 is wrapped by the upper rod soft goods 3. In one of the embodiments of the present application, the upper rod soft goods 3 is fixed via a pressing rod 211 provided below the upper rod 21 and fixed to the upper rod 21. The pressing rod 211 can prevent the upper rod soft goods 3 wrapping the upper rod 21 from wrinkling. As another fixing manner of the upper rod soft goods 3, as shown in FIG. 9, in this case, the upper rod 21 is provided with a groove 221 in a middle portion thereof. The upper rod soft goods 3 is fixed in the groove 221. The fixing of the upper rod soft goods 3 on the upper rod 21 is mainly determined that it is beneficial to the upper rod soft goods 3 not to wrinkle easily when the upper rod soft goods 3 is lowered. The arrangement of the upper rod soft goods 3 can be selected according to the specific situation.

Figure 6:
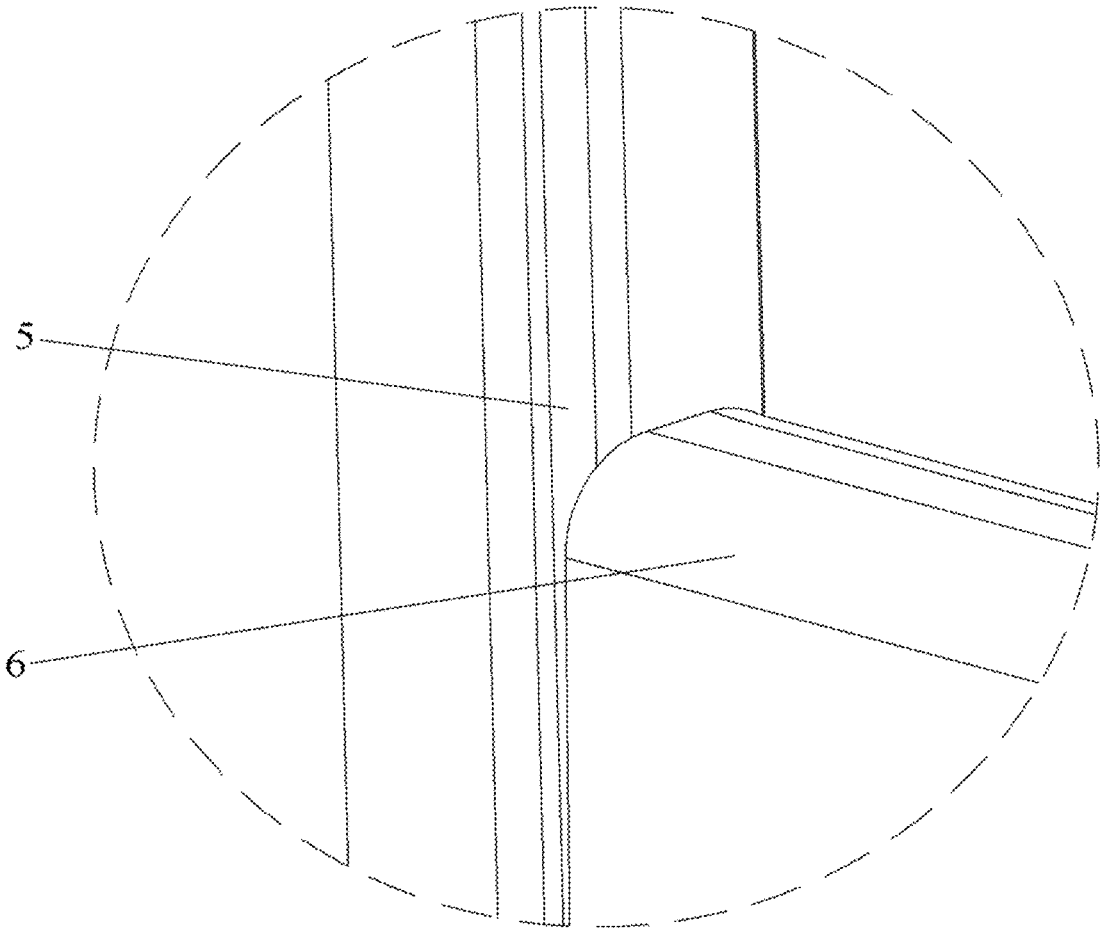
FIG. 6 is an enlarged view of a portion A shown in FIG. 2.

In order to implement the height adjustment of the entire upper rod 21 or a portion of the upper rod 21 on one of the sides of the crib frame in the vertical direction between the upper end and the lower end of the crib frame 1, FIGS. 2 and 6 show an implementation of a embodiment. As shown in the figures, the upper rod 21 is provide on one of the sides of the crib frame 1. In the crib frame 1, an inner side of the erect rod 11 facing the upper rod 21 is provided with a sliding groove 5 extending in the vertical direction. Two sliding grooves 5 may be provided opposite to each other. Both ends of the upper rod 21 (referring to FIG. 7) are fixedly provided with sliding blocks 6 slidable in the sliding groove 5. In other words, the whole upper rod 21 is slidable in the sliding groove 5. The sliding block 6 slides along the sliding groove 5 and drives the upper rod 21 and the upper rod soft goods 3 to move, so as to drive the elastic member 41 (referring to FIGS. 1 to 5) to be contracted or stretched. When the sliding block 6 slides downward along the sliding groove 5, the sliding block 6 drives the elastic member to be contracted. The force generated by the contraction of the elastic member 41 pulls the upper rod soft goods 3 to move and maintains it in an unfolded state. When the sliding block 6 slides upward along the sliding groove 5, the sliding block 6 drives the elastic member 41 to be stretched, and the elastic member 41 pulls the upper rod soft goods 3 to move in a direction opposite to the former, and still maintains the upper rod soft goods 3 in the unfolded state. The sliding block 6 may be provided with a protrusion that matches the sliding groove 5. The sliding block 6 slides along the sliding groove 5 by the protrusion. One of the sides of the crib frame 1 is provided with a sliding structure for the portion of the upper rod 21 (as shown in FIG. 3), which means that the sliding groove 5 is provided on the vertical rod 13 between the adjacent erect rods 11 of the crib frame 1. The sliding manner and detailed structure of the sliding structure is similar to those described above, and will not be repeated herein.

Figure 8:
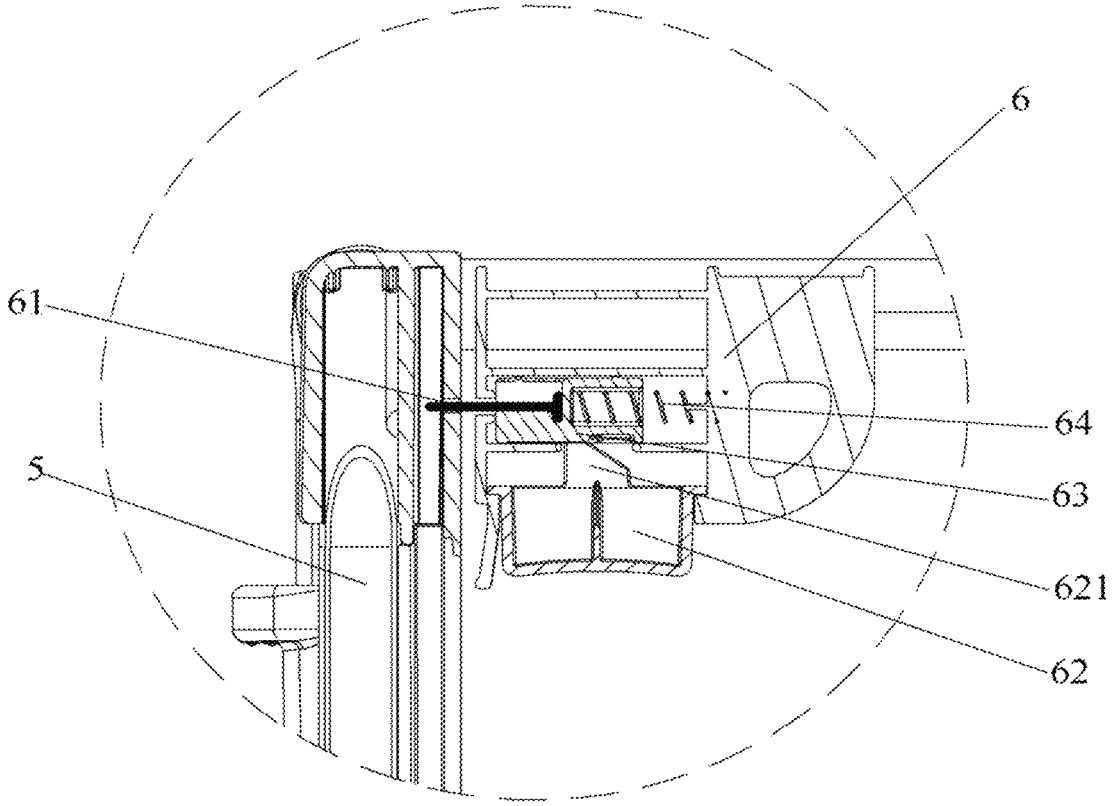
FIG. 8 is an enlarged view of a portion B shown in FIG. 7.

In order to implement that the upper rod 21 can slide up and down in the vertical direction and can be fixed on the crib frame 1, another embodiment is provided in FIG. 8. The sliding block 6 is provided with a locking member 61, a driving member 63, and an operating member 62. The locking member 61 is engaged in a positioning groove 8 on the crib frame 1 (referring to FIG. 2 or 5) and is fixedly connected to the driving member 63. The operating member 62 is operated to drive the driving member 63 to move and to drive the locking member 61 to be separated from the positioning groove 8. The operating member 62 is provided with an inclined surface 621. After the operating member 62 is operated, the inclined surface 621 pushes the driving member 63 and drives the driving member 63 to move to separate the locking member 61 from the positioning groove 8. Specifically, the positioning groove 8 is located on an upper portion of the crib frame. The locking member 61 may be a latching pin. After the operating member 62 is operated, the inclined surface 621 pushes the driving member 63 and drives the driving member 63 to move to separate the latching pin from the positioning groove 8. The sliding block 6 further includes a resetting member 64. One end of the resetting member 64 is fixed to the driving member 63, and the other end thereof is fixed to the sliding block 6. The resetting member 64 can drive the driving member 63 to be reset, so as to drive the locking member 61 to be engaged in the positioning groove 8. Specifically, the resetting member 64 may be a spring. The driving member 63 may compress the resetting member 64 during the pushing movement of the inclined surface 621 of the operated member 62. After the locking member 61 is separated from the positioning groove 8, the sliding block 6 slides downward with respect to the sliding groove 5, so as to drive the upper rod soft goods 3 to move downward. Correspondingly, when the sliding block 6 moves upward to the position where the positioning groove 8 is located, the operating member 62 is released. Therefore, subject to the resilient force of the resetting member 64, the locking member 61 is engaged in and fixed with the positioning groove 8 again, such that the sliding block 6 is fixed to the sliding groove 5.

Referring to FIG. 1 again, in one of the embodiments of the present application, the baby crib 100 further includes a support member 7 supporting the crib frame 1. The support member 7 includes a cross beam 72 and a vertical beam 71. One end of the vertical beam 71 is connected to the crib frame 1, and the other end thereof is connected to the cross beam 72. The cross beam 72 is provided with casters 721, such that the baby crib 100 can be moved to a desired position.

The above-disclosed are only examples of the present application, and cannot be used to limit the scope of rights of the present application. Therefore, equivalent changes made according to the claims of the present application are fallen within the scope of the present application.

What is claimed is:

1. A baby crib, comprising:

a crib body comprising:

a crib frame formed by a plurality of rods comprising an upper rod;

a plurality of soft goods made of a soft material and fixed on the crib frame, the plurality of soft goods comprising a soft goods provided on the upper rod fixed on the upper rod;

a crib accommodating space enclosed by the crib frame and the soft goods;

wherein an entire upper rod or a portion of the upper rod on one side the crib frame is adjustable in height in a vertical direction between upper and lower ends of the crib frame;

wherein the crib frame is provided with a tightening mechanism, one end of the tightening mechanism is fixed to the crib frame, and an other end of the tightening mechanism is connected to the soft goods provided on the upper rod;

when the upper rod is adjusted in height and drives the soft goods provided on the upper rod to move, the tightening mechanism is capable of being contracted or stretched correspondingly to provide a tightening force to the soft goods provided on the upper rod;

wherein the tightening mechanism is provided at a bottom of the crib frame, the soft goods provided on the upper rod extend to the bottom of the crib frame and are connected to the other end of the tightening mechanism;

wherein the tightening mechanism is a furling mechanism, wherein the furling mechanism comprises:

a furling disk, a shaft, and a coil spring, wherein the furling disk is capable of rotating around the shaft and the coil spring is configured to drive the furling disk to rotate around the shaft, wherein the furling disk comprises:

a first gear disk, a second gear disk, a furling shaft fixed between the first gear disk and the second gear disk, and a flared segment provided at a connected portion between the first gear disk and the second gear plate disk, and the furling shaft, wherein the furling shaft is fixed to one end of the soft goods provided on the upper rod;

wherein a length of the furling shaft is greater than a width of the soft goods provided on the upper rod, and a diameter of the flared segment decreases with the increase of the distance from the first gear disk or the second gear disk.

2. The baby crib according to claim 1, wherein the soft goods provided on the upper rod wrap the upper rod, and the soft goods provided on the upper rod are fixed via a pressing rod provided below the upper rod and fixed to the upper rod.

3. The baby crib according to claim 1, wherein the upper rod is provided with a groove in a middle portion thereof, and the soft goods provided on the upper rod are fixed in the groove.

4. The baby crib according to claim 1, wherein the crib frame is provided with a sliding groove in the vertical direction at a side thereof where the upper rod is provided, both ends of the upper rod are fixedly provided with a sliding block capable of sliding in the sliding groove, the sliding block slides along the sliding groove and drives the upper rod and the soft goods provided on the upper rod to move.

5. The baby crib according to claim 4, wherein the sliding block is provided with a locking member, a driving member, and an operating member, the locking member is engaged in a positioning groove on the crib frame and is fixedly connected to the driving member, the operating member is operated to drive the driving member to move, and to drive the locking member to be separated from the positioning groove.

6. The baby crib according to claim 5, wherein the operating member is provided with an inclined surface, after the operating member is operated, the inclined surface pushes the driving member and drives the driving member to move, so as to separate the locking member from the positioning groove.

7. The baby crib according to claim 6, wherein the sliding block further comprises a resetting member, one end of the resetting member is fixed to the driving member, and an other end of the resetting member is fixed to the sliding block, the resetting member is capable of driving the driving member to be reset and driving the locking member to be engaged in the positioning groove.

8. The baby crib according to claim 1, further comprising a support member supporting the crib body, wherein the support member comprises a cross beam and a vertical beam, one end of the vertical beam is connected to the crib frame, and an other end of the vertical beam is connected to the cross beam, the cross beam is provided with a caster.

* * * * *